US007780034B1

(12) United States Patent
Richardson

(10) Patent No.: US 7,780,034 B1
(45) Date of Patent: Aug. 24, 2010

(54) PORTABLE BAR

(76) Inventor: John F. Richardson, 1595 Elkay Dr., Eugene, OR (US) 97404

( * ) Notice: Subject to any disclaimer, the term of this patent is extended or adjusted under 35 U.S.C. 154(b) by 812 days.

(21) Appl. No.: 11/714,468

(22) Filed: Mar. 5, 2007

(51) Int. Cl.
*A47J 41/00* (2006.01)
*F25D 23/00* (2006.01)
*B65D 75/00* (2006.01)

(52) U.S. Cl. ..... 220/592.18; 220/592.03; 206/199

(58) Field of Classification Search ..... 220/592.15, 220/592.16, 592.18, 915.1, 915.2; 190/31, 190/32; 62/3.62; 222/131–135, 129.1–129.4; 206/199
See application file for complete search history.

(56) References Cited

U.S. PATENT DOCUMENTS 4,113,147 A 9/1978 Frazier et al.
5,437,165 A * 8/1995 White et al. ..... 62/465
6,186,351 B1 * 2/2001 Coyle ..... 220/23.83
6,269,965 B1 * 8/2001 White et al. ..... 220/592.18
6,834,838 B2 * 12/2004 Dennis et al. ..... 248/311.2
7,178,673 B1 * 2/2007 Miller ..... 206/545
2008/0237248 A1 * 10/2008 Dente et al. ..... 220/729

* cited by examiner

*Primary Examiner*—Anthony Stashick
*Assistant Examiner*—Shawn M Braden
(74) *Attorney, Agent, or Firm*—Robert E. Howard

(57) ABSTRACT

A portable bar including an ice chest, a removable tray, and a plurality of beverage containers attached to the upper surface of the tray. The ice chest has a rim located on the interior thereof adjacent its upper perimeter edge. The removable tray is adapted to rest on the rim with either its upper or lower surface facing towards the interior of the ice chest. Each of the beverage containers has a manually operated pump dispenser removably attached thereto and providing a lid thereto. In its transportation and storage configuration, the upper surface of the tray and attached beverage containers face downwardly towards the interior of the ice chest. In its service configuration, the upper surface of the tray and attached beverage containers face upwardly.

11 Claims, 3 Drawing Sheets

PORTABLE BAR

BACKGROUND OF THE INVENTION

The present invention relates to a portable bar for dispensing beverages.

It is common to provide beverages to groups of people on outings, such as picnics, tail gate parties, tours, etc. For adult outings both alcoholic beverages and mixers may be provided. These beverages are typically served out of the bottles in which they are sold, either by a designated server or by the individuals participating in the outing. Serving beverages in this manner can lead to spills, difficulty in locating a particular beverage bottle, and in general to a disorganized situation.

Portable bars, such as those used on home patios, are large and not suited for transport in a vehicle.

It would be desirable to have a portable bar that is compact and can be easily transported to the location of an outing or used on a tour bus.

SUMMARY OF THE INVENTION

The portable bar of the present invention includes a cooler chest and a tray to which is attached a plurality of beverage containers. The edges of the tray are adapted to rest on an interior rim encircling the upper portion of the cooler chest. Each beverage container includes a manually operated pump dispenser for dispensing beverages from the container.

During storage and transportation the tray is placed onto the rim of the cooler chest with the beverage containers facing into the interior of the cooler chest. The portable bar is transported to the location where it is desired to serve beverages. The lid of the cooler chest is raised or removed, the tray and attached beverage containers removed, and ice placed into the interior of the chest. The tray, with the beverage containers facing upwardly, is placed onto the interior rim of the cooler chest. The pump dispensers, forming the lids of the beverage containers are removed, and the containers filled with beverages. The pump dispensers are reattached to the containers, and beverages can be dispensed into cups or glasses by manually operating the pump dispensers. The ice within the chest can be accessed through an opening in the tray.

The beverage containers form two rows with the containers forming the front row being shorter than the containers forming the rear row. The smaller containers are can preferably be used for holding alcoholic beverages, and the larger containers can preferably be used for holding mixers or soft drinks.

DESCRIPTION OF PREFERRED EMBODIMENTS

Figure 1:
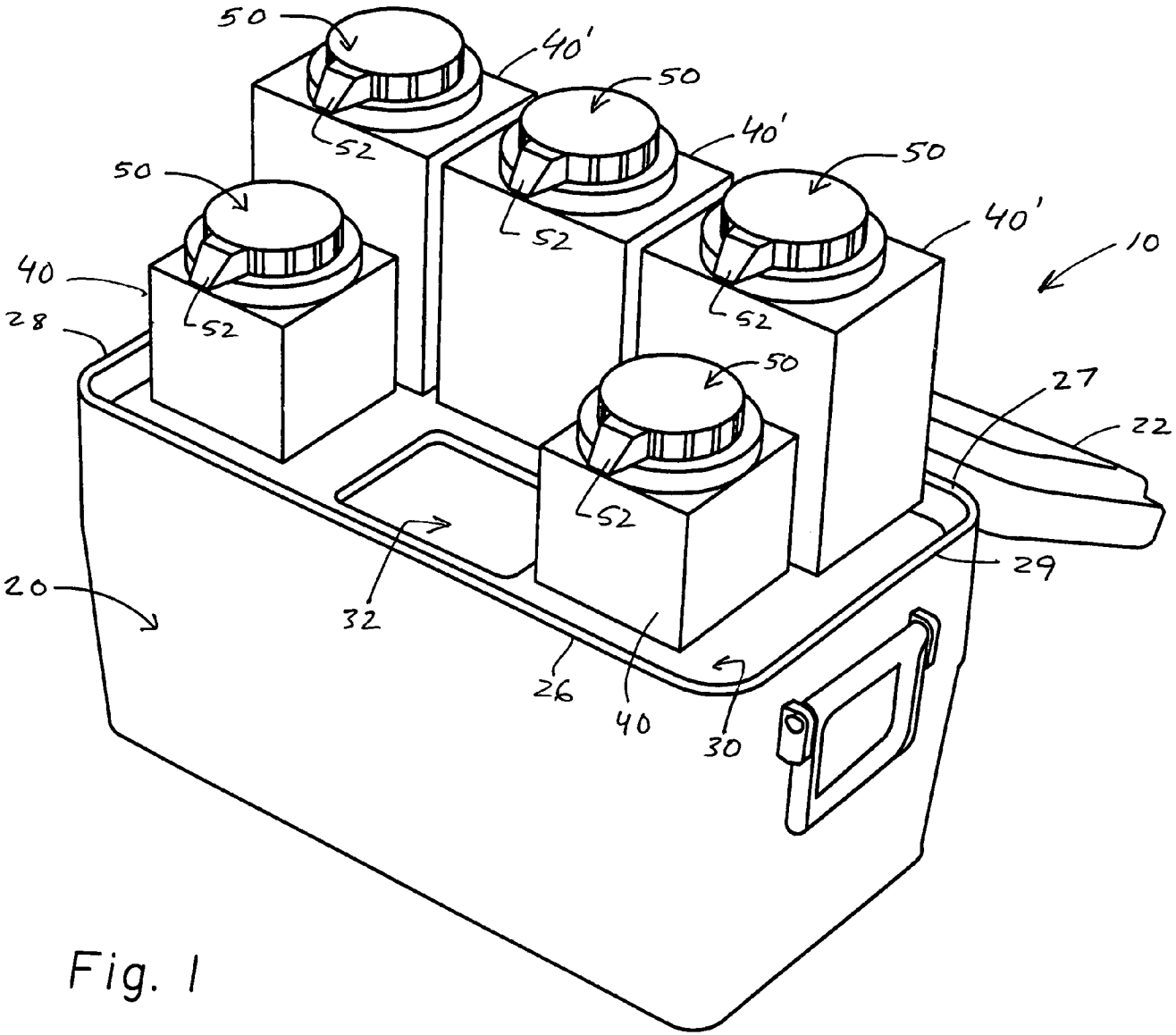
FIG. 1 is a perspective view of the portable bar of the present invention with the beverage containers shown in their beverage dispensing configuration.
Figure 2:
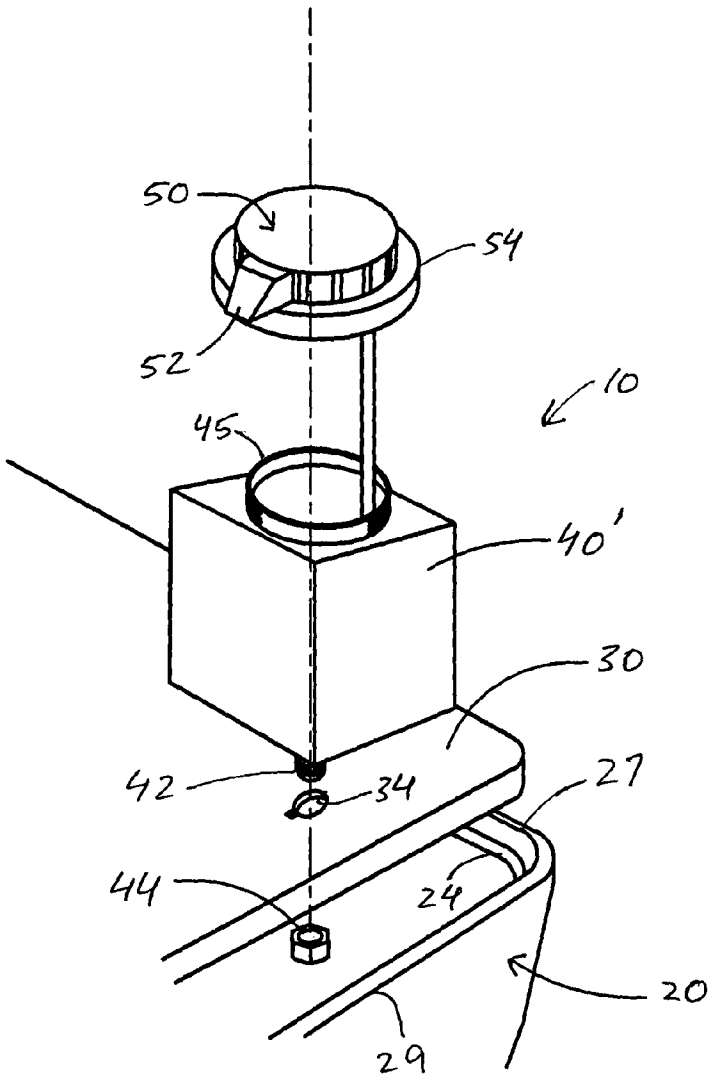
FIG. 2 is an exploded perspective view of a single beverage container, its pump dispenser, a partial view of the tray to which the beverage container is attached, and a partial view of the associated ice chest.

The portable bar 10 includes an ice chest 20, a tray 30, and a plurality of beverage containers 40, 40'. Each beverage container 40, 40' is equipped with a pump dispenser 50 which also forms the lid of the beverage containers.

Ice chest 20 can be any readily available type, and has a lid 22 that can be either hinged to allow the lid 22 to be folded back about a hinge, as shown in FIG. 1, or removed (not shown).

Ice chest 20 has a rim 24 located on the interior thereof adjacent the upper perimeter edge of the chest. The upper perimeter edge has a front portion 26, a rear portion 27, a right side portion 28, and a left side portion 29. If the ice chest 20 does not come with a rim 24, a rim 24 is installed. Rim 24 can be continuous or discontinuous as long as it is adapted to support tray 30 and filled beverage containers 40, 40'.

Tray 30 is generally rectangular, and has a size adapted to allow the outer edges of the tray 30 to abut rim 24 and releasably rest thereon.

Tray 30 has an access opening 32 adjacent front edge 26 of ice chest 20 to allow access to ice cubes placed within the interior of ice chest 20. Access opening 32 is preferably in a mid-portion of the tray 30, as shown in FIG. 1, but can be located on the right or left side thereof.

A plurality of identical container attachment openings 34 pass through the tray 30 and are located to receive identical threaded fastener members 42 extending from the bottoms of containers 40, 40'. Openings 34 are circular, with a slot extending towards the front edge 26 of ice chest 20 and substantially perpendicular thereto.

Beverage containers 40 are preferably substantially identical in size, and beverage containers 40' are preferably substantially identical in size. Beverage containers 40, 40' are preferably square in cross-section. Beverage containers 40 are shorter than beverage containers 40' in order that spouts 52 of containers 40' are higher than the spouts 52 of containers 40, and, therefore, are easily accessed during use. Since beverage containers 40' are larger than beverage containers 40, the higher use volume beverages (typically mixers) would preferably be placed therein. The smaller containers 40 would preferably have the smaller use volume beverages (typically alcoholic beverages) placed therein. Although not intended to be limiting, it has been found that smaller containers 40 having a volume of about 0.5 gallon and larger beverage containers 40' having a volume of about 1.0 gallon are satisfactory.

It is preferred that beverage containers 40, 40' be releasably attached to tray 30 to allow for easier cleaning. Identical threaded fastener members 42 of beverage containers 40, 40' extend downwardly from a mid-portion of the bottoms of containers 40, 40'. Each threaded fastener member 42 has a key at its base (not shown) adapted to fit into the slots of openings 34 to thereby orient containers 40, 40' with the spouts 52 of pump dispensers 50 facing towards the front edge 26 of ice chest 20. Nuts 44 are threaded onto threaded fastener members 42 and tightened to secure beverage containers 40, 40' to the upper surface of tray 30.

Although it is preferred to releasably attach beverage containers 40, 40' to tray 30 by use of threaded fasteners, as just described, beverage containers 40, 40' can be attached to the upper surface of tray 30 by any suitable releasable or non-releasable means.

Pump dispensers 50 form the lids of beverage containers 40, 40', and are attached thereto by internal threads located inside the rim portion 54 of pump dispensers 50 which mate with external threads located on the neck portions 45 of beverage containers 40, 40'. Pump dispensers 50 are of the type commonly used with vacuum bottle type coffee carafes, and are described in U.S. Pat. No. 4,113,147.

Figure 3:
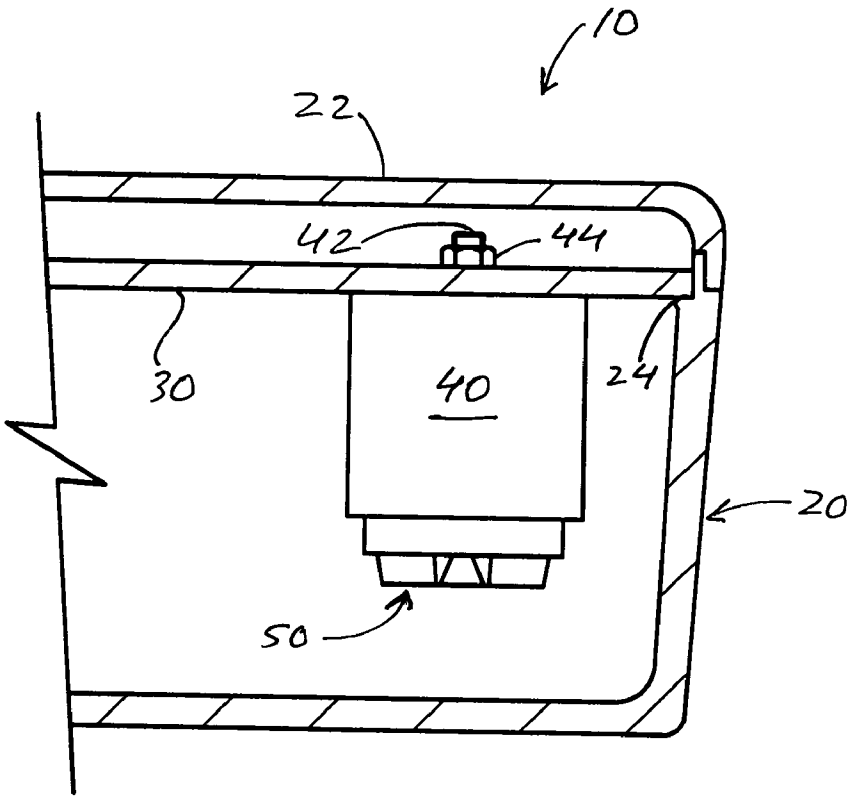
FIG. 3 is a cross-sectional view of a single beverage container and its pump dispenser, a partial view of the tray, and a partial view of the associated ice chest, the beverage container shown in its inverted storage and transportation configuration

In use, portable bar 10 would be transported to the site of use in its transportation configuration, as shown in FIG. 3. In its transportation configuration beverage containers 40, 40' would be empty and clean, and tray 30 inverted with its upper surface facing downwardly so that containers 40, 40' extend downwardly towards the interior of ice chest 20. In the transportation configuration, lid 22 of ice chest 20 would be closed.

Once the portable bar 10 has been transported to the site of use, it is transformed into its bar service configuration, as shown in FIG. 1. Lid 22 is opened or removed. Tray 30 and attached beverage containers 40, 40' are removed and ice cubes placed into the interior of ice chest 20. Tray 30 with attached containers 40, 40' is placed back onto the ledge 24 of ice chest 20 with its upper surface facing upwardly and containers 40, 40' in their upright, beverage dispensing, position. Pump dispensers 50 would be removed and beverage containers 40, 40' filled with selected beverages. Pump dispensers 50 would then be placed back onto containers 40, 40', and the portable bar 10 is ready for use.

A person fixing a drink would reach through opening 32 in tray 30 to obtain ice cubes contained in the interior of ice chest 20 for their cup or glass. The person would then place an appropriate amount of a selected beverage or beverages into their cup or glass by manually pumping the appropriate pump dispenser or dispensers 50.

At the end of the outing, the beverages remaining in beverage containers 40, 40' are poured back into their original containers, tray 30 inverted and placed onto rim 24 of ice chest 20 with beverage containers 40, 40' pointing towards the interior of ice chest 20 as shown in FIG. 3, and lid 22 closed.

While portable bar 10 has been described as having three beverage containers 40' in the back row and two beverage containers 40 in the front row, the number of beverage containers 40, 40' can vary depending on their size and on the size of the ice chest 20.

It will be obvious to those having skill in the art that many changes may be made to the details of the above-described embodiments of this invention without departing from the underlying principles thereof. The scope of the present invention should, therefore, be determined only by the following claims.

The invention claimed is:

1. A portable bar comprising:

an ice chest having an interior and an exterior, and an upper perimeter edge, said upper perimeter edge having a front portion, a rear portion, and side portions;

a rim located on the interior of said ice chest adjacent said upper perimeter edge thereof;

a removable tray having an upper and lower surface, said tray adapted to rest on said rim with either its upper or lower surface facing towards said interior of said ice chest; and a plurality of beverage containers attached to said upper surface of said tray, each of said beverage containers having a pump dispenser removably attached thereto and providing a lid thereto;

said portable bar adapted during transport or storage to have said upper surface of said removable tray facing downwardly towards the interior of said ice chest with said beverage containers attached to said upper surface extending downwardly into the interior of said ice chest;

said portable bar adapted during use to have said upper surface of said removable tray facing upwardly with said beverage containers attached to said upper surface extending upwardly in a beverage dispensing position.

2. The portable bar of claim 1 wherein said beverage containers are removably attached to said upper surface of said tray.

3. The portable bar of claim 2 wherein said beverage containers each have a threaded fastener extending vertically from the bottom thereof along the longitudinal axis thereof, said tray having a container attachment opening passing therethrough at the location of the longitudinal axis of each of said containers, each of said threaded fasteners extending through one of said container attachment openings, and a nut threadably fastened to each of said threaded fasteners to removably secure each of said beverage containers to said tray.

4. The portable bar of claim 1 wherein a first plurality of said beverage containers are located adjacent said front portion of said upper perimeter edge of said ice chest to form a front row of beverage containers, and a second plurality of said beverage containers are located adjacent said rear portion of said upper perimeter edge to form a second row of beverage containers.

5. The portable bar of claim 4 wherein said beverage containers in said front row are shorter than the beverage containers in said second row.

6. The portable bar of claim 4 wherein said tray has an access opening in said front row to allow access to the interior of said ice chest when said upper surface of said removable tray is facing upwardly with said attached beverage containers in an upright beverage dispensing position.

7. The portable bar of claim 6 wherein said access opening is located in a mid-portion of said front row.

8. The portable bar of claim 1 including a lid adapted to be seated on said ice chest adjacent said upper perimeter edge when said upper surface of said removable tray is facing downwardly towards the interior of said ice chest with said attached beverage containers extending downwardly into the interior of said ice chest.

9. The portable bar of claim 8 wherein said lid is attached by a hinge to said ice chest adjacent the rear of said upper perimeter edge.

10. The portable bar of claim 4 wherein there are two beverage containers in said front row and three beverage containers in said second row.

11. The portable bar of claim 4 wherein said beverage containers in said front row have a volume of about 0.5 gallon and said beverage containers in said second row have a volume of about 1.0 gallon.

* * * * *